United States Patent [19]

Albertsen

[11] Patent Number: 4,779,607

[45] Date of Patent: Oct. 25, 1988

[54] STOVE

[75] Inventor: Peter S. Albertsen, Warwick, R.I.

[73] Assignee: Nu-Tec Incorporated, East Greenwich, R.I.

[21] Appl. No.: 113,554

[22] Filed: Oct. 26, 1987

Related U.S. Application Data

[63] Continuation of Ser. No. 10,350, Feb. 3, 1987, abandoned, which is a continuation of Ser. No. 826,414, Feb. 5, 1986, abandoned.

[51] Int. Cl.[4] ..... F24C 1/14

[52] U.S. Cl. ..... 126/77; 126/58; 110/214

[58] Field of Search ..... 126/77, 58, 112, 117, 126/130, 131; 110/210, 211, 214

[56] References Cited

U.S. PATENT DOCUMENTS

| | | | |
|---|---|---|---|
| 2,845,882 | 8/1958 | Bratton | 110/346 |
| 4,319,556 | 3/1982 | Schwartz et al. | 126/77 |
| 4,646,712 | 3/1987 | Ferguson et al. | 126/77 |

FOREIGN PATENT DOCUMENTS 854299 11/1960 United Kingdom .

OTHER PUBLICATIONS

PCT Application WO85/02455, publication date Jun. 6, 1985; Inventor—Ferguson et al.

*Primary Examiner*—Carroll B. Dority, Jr.

[57] ABSTRACT

A stove for burning fuel in which secondary air is introduced and mixed with the products of combustion in a firebox with primary air, the secondary air being kept from the firebox by a gravity-induced downward movement owing to the greater density of the secondary air-combustion products mixture as compared with the products of combustion per se.

9 Claims, 1 Drawing Sheet

STOVE

This application is a continuation of application Ser. No. 010,350, filed 2/3/87, now abandoned, which in turn was a continuation of application Ser. No. 826,414, filed 2/5/86 and now abandoned.

FIELD OF THE INVENTION

This invention relates to stoves.

BACKGROUND OF THE INVENTION

U.S. Pat. No. 4,319,556, "Catalytic Stove", granted to Schwartz et al. Mar. 16, 1982, taught use in a wood-burning stove of heated secondary air. Other prior art stoves have taught introduction of primary air at the bottom of the stoves.

SUMMARY OF THE INVENTION

I have discovered that secondary air may be isolated from a combustion chamber in which primary air is used for burning by taking advantage of the greater density, relative to hot air, of cold air.

In preferred embodiments, the secondary air is heated by heat exchange through one or more walls of the combustion chamber, a catalytic converter is included toward the downstream end of a secondary air passage, temperature of gas into the catalytic converter is regulated by varying the rate of introduction of secondary air, primary air combustion products are mixed with secondary air in an elevated zone, and secondary air is introduced at a lower zone.

DESCRIPTION OF THE PREFERRED EMBODIMENT

The preferred embodiments, shown in the drawings, have the following structure and mode of operation.

DRAWINGS

STRUCTURE

Figure 1:
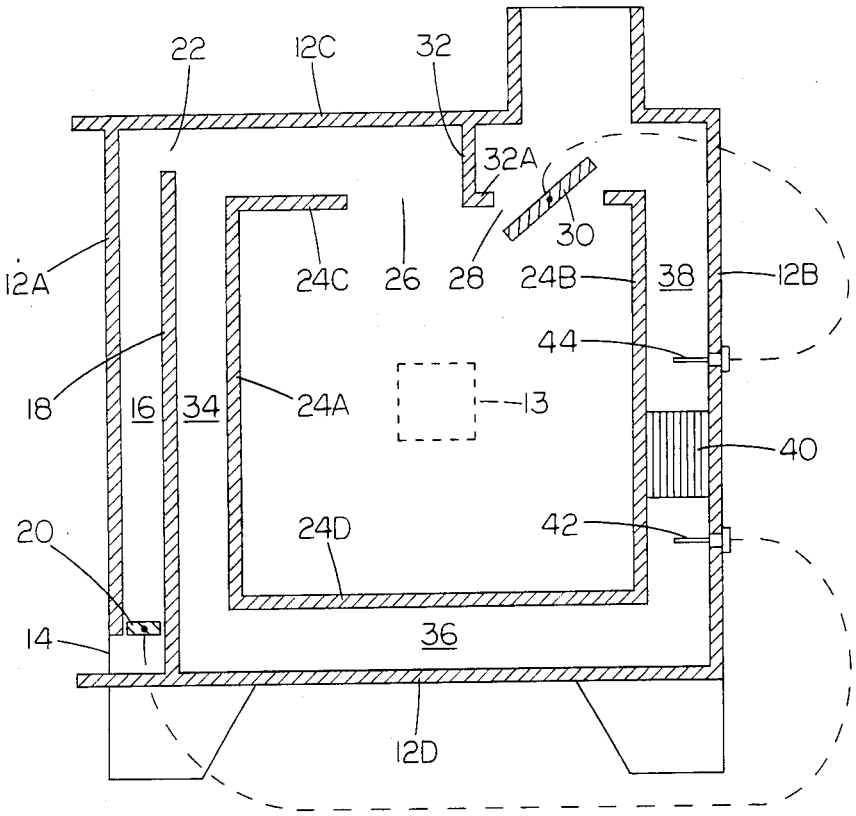
FIG. 1 is a diagrammatic view in vertical section of the most preferred embodiment.

The wood stove shown generally at 10 in FIG. 1 comprises a housing with side walls 12*a* and 12*b*, top wall 12*c*, bottom wall 12*d*, and back and front walls (not shown). Located in the front wall are a door (not shown) through which wood may be introduced and an opening 13, indicated diagrammatically by dashed lines, for admission therethrough of primary air.

Beneath wall 12*a* is secondary air opening 14 to passage 16 defined by baffle 18 with wall 12*a* and bottom 12*d*, in the latter of which it is sealedly mounted. Flow through passage 16 is regulable by means of valve 20. The top of baffle 18 defines with top wall 12*c* opening 22.

The combustion chamber 24 includes side walls 24*a* and 24*b*, top wall 24*c*, bottom wall 24*d*, and front and back walls not shown, provision being made in the front wall for passage therethrough of the wood and primary air above mentioned. Top wall 24*c* is relieved to provide openings 26 and 28, in the latter of which is mounted for selectively opening and closing thereof valve 30. Baffle 32 depends from wall 12*c* and has wider lower end 32*a*.

The walls of combustion chamber 24 define with baffle 18 and walls 12*d*, 12*b* and 12*c* passages 34, 36, and 38, across the latter of which is mounted catalytic converter 40.

Oxygen sensor ("automotive type") 42 regulates the amount of opening of valve 20, to control the fuel mixture ratio, and is located at the entrance to catalytic converter 40. Temperature sensor 44 regulates the degree of opening of bypass valve 30, which it opens at temperatures below 650° F.

Figure 2:
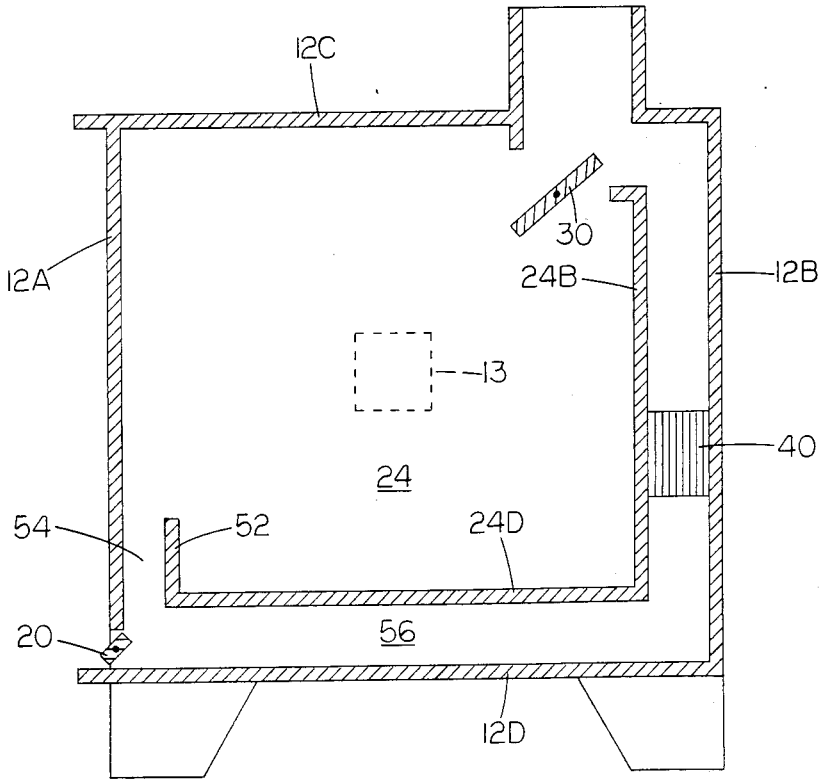
FIG. 2 is a diagrammatic view in vertical section of a modified embodiment.

FIG. 2 construction is simpler. Outer walls and openings therethrough are as in FIG. 1. Wall 12*a* has in it valve 50 regulating flow therethrough, and defines with short combustion chamber wall 52 passage 54. Combustion chamber wall portion 24*d* defines with bottom wall 12*d* passage 56. Combustion wall portion 24*b* defines with wall portion 12*b* passage 38 containing catalytic converter 40. Bypass valve 30 is mounted to selectively close the bypass outlet of the combustion chamber.

The device may also desirably include means (not shown) to open damper 30 for bypass when the primary box door is opened. Actual stove temperature may be regulated through a thermostat in the firebox (not shown).

A primary combustion chamber outlet passage is provided between walls 12*c* and 24*c* (providing a horizontal portion of the passage) and baffle 18 and wall 24*a* (providing a vertical portion of the passage) in the FIG. 1 embodiment and by passage 54 in the FIG. 2 embodiment. The secondary combustion chambers include passages 36 (in FIG. 1) and 56 (in FIG. 2) below lower walls 24*d* of the stoves.

OPERATION

In the FIG. 1 embodiment, logs and primary air are introduced into the combustion chamber 24, and burning caused.

In normal operation, bypass valve 30 is closed, so that gases from combustion chamber 24 emerge through opening 26, and encounter above mixing chamber passage 34 secondary air from passage 16. The lower temperature of the latter, even as mixed with the products of combustion, causes the mixture to descend through passage 34 and pass along passage 36, all the while being heated by heat transfer through walls 24*a* and 24*d*, and then 24*b*. The heated mixture then passes through catalytic converter 40.

Sensor 42 operates secondary air inlet valve to adjust the ratio of air to unburned fuel in the mixture reaching the catalytic converter. Temperature sensor 44 operates bypass valve 30, to open it at temperatures below 650° F.

Positioning secondary air inlet 20 toward the bottom of passage 16 gives the chimney effect of the full length of that passage, and reduces any likelihood of smoke moving down passage 16.

The effective isolation of secondary air from the firebox, and using it in the manner described, enables achievement of clean burning without the overheating caused with so-called secondary air is introduced in ways that enable it to get into the firebox (primary combustion chamber), where it unwantedly unduly increases stove temperature.

The FIG. 2 embodiment is simpler, and provides less heat exchange. Mixing of combustion air and secondary air occurs in passages 54 and 56, as well as in that just below the catalytic converter 40, heat exchange from the combustion chamber walls occurring all this time.

OTHER EMBODIMENTS

Other embodiments are within the scope of the following claims.

Thus, any catalytic converter may be omitted, temperature being made high enough in passages carrying the second air mixture to cause combustion there.

What is claimed is:

1. A stove comprising means forming a primary combustion chamber, means forming a primary air inlet in communication with said primary combustion chamber, means forming a secondary combustion chamber including portions below said primary combustion chamber in said stove, means forming a primary combustion chamber outlet passage, means forming a secondary air inlet, said secondary air inlet being in communication with said primary combustion chamber outlet passage to provide a mixture of primary combustion products and secondary air, said mixture being cooler than said combustion products and therefore having a higher density than said combustion products, a secondary air inlet valve controlling flow of said secondary air through said secondary air inlet independently of flow of primary air through said primary air inlet, said secondary combustion chamber including a passage that is lower than said primary combustion chamber outlet passage and receives said mixture of combustion products and secondary air from said secondary air inlet, said secondary air being isolated from said primary chamber by said higher density and the gravity effect, said secondary combustion chamber including a secondary outlet for secondary combustion products, a bypass valve at a bypass opening at the top of said primary combustion chamber for bypassing said secondary chamber when opened and causing flow of primary combustion products into said secondary chamber when closed, and flue means in communication with said bypass opening and said secondary outlet for transport of combustion products.

2. The stove of claim 1 in which said passage of said secondary combustion chamber is in heat exchange relationship with said primary combustion chamber through a metal wall therebetween.

3. The stove of claim 1 in which said secondary combustion chamber includes a catalytic converter.

4. The stove of claim 3 in which said stove includes an oxygen sensor, said oxygen sensor being mounted upstream of said catalytic converter and being operatively connected to control the amount of opening of said secondary air inlet valve.

5. A stove comprising means forming a primary combustion chamber, means forming a primary air inlet in communication with said primary combustion chamber, means forming a secondary combustion chamber including portions below said primary combustion chamber in said stove, means forming a primary combustion chamber outlet passage that has an entrance located in an upper portion of said primary chamber and extends downward to said secondary combustion chamber, means forming a secondary air inlet that enters said stove near the bottom and extends upward along a side of the stove and is in communication with said primary combustion chamber outlet passage at an opening in an upper portion of said primary combustion chamber outlet passage to provide a mixture of primary combustion products and secondary air, said mixture being cooler than said combustion products and therefore having a higher density than said combustion products, a secondary air inlet valve controlling flow of said secondary air through said secondary air inlet independently of flow of primary air through said primary air inlet, said secondary combustion chamber including a passage that is lower than said primary combustion chamber outlet passage and receives said mixture of combustion products and secondary air from said secondary air inlet, said secondary combustion chamber including a secondary outlet for secondary combustion products, a bypass valve at a bypass opening at the top of said primary combustion chamber for bypassing said secondary chamber when opened and causing flow of primary combustion products into said secondary chamber when closed, and flue means in communication with said bypass opening and said secondary outlet for transport of combustion products.

6. The stove of claim 1 in which said secondary air inlet is in communication with said primary combustion chamber outlet passage at an opening in a lower portion of said primary combustion chamber outlet passage.

7. The stove of claim 1 wherein said means forming a primary combustion chamber comprises means providing a primary wall surface providing a lower boundary of said primary combustion chamber, and said means forming a secondary combustion chamber comprises means providing a secondary wall surface providing an upper boundary of said secondary combustion chamber.

8. The stove of claim 7 wherein said means forming a secondary combustion chamber comprises a lower wall that is spaced from the lower than said secondary wall.

9. The stove of claim 8 wherein said primary wall and said secondary wall are provided by a common wall.

* * * * *